US006109282A

United States Patent [19]

Yoon

[11] Patent Number: 6,109,282

[45] Date of Patent: Aug. 29, 2000

[54] SELF-ERECTING LOOP STRUCTURE

[76] Inventor: Young W. Yoon, 127 Michael Mannor, Glenview, Ill. 60025

[21] Appl. No.: 09/176,642

[22] Filed: Oct. 21, 1998

[51] Int. Cl.[7] ..... E04H 15/40

[52] U.S. Cl. ..... 135/126; 135/124; 135/128

[58] Field of Search ..... 135/121, 124–126, 135/128, 132, 133, 137, 905

[56] References Cited

U.S. PATENT DOCUMENTS

| | | | |
|---|---|---|---|
| Re. 35,571 | 7/1997 | McLeese | 135/126 |
| 5,385,165 | 1/1995 | Hazinski | 135/126 |
| 5,439,017 | 8/1995 | Brown | 135/126 |
| 5,645,096 | 7/1997 | Hazinski | 135/126 |
| 5,676,168 | 10/1997 | Price | 135/126 |
| 5,816,278 | 10/1998 | Kim | 135/126 |

*Primary Examiner*—Beth A. Aubrey
*Attorney, Agent, or Firm*—Price, Heneveld, Cooper, DeWitt & Litton

[57] ABSTRACT

A self erecting tent structure comprises a compact, easily erected, and easily packed portable structure. A body comprised of flexible sheetlike material is supported by a resilient, single closed loop frame. The tent is generally stable and requires no support from attachment to the ground to remain upright by virtue of a low center of gravity provided by a roof portion having a generally hourglass shape, and preferably includes side walls descending from the roof portion at near vertical angles.

16 Claims, 2 Drawing Sheets

FIG. 7A
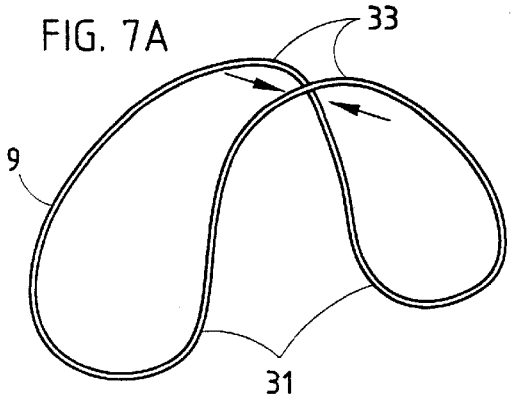
FIG. 7C
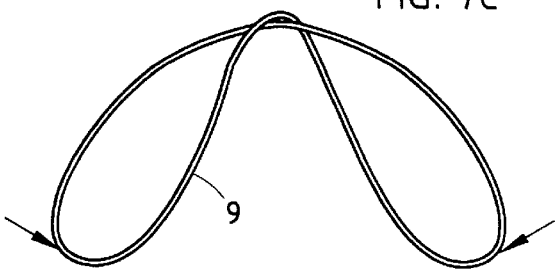
FIG. 7B
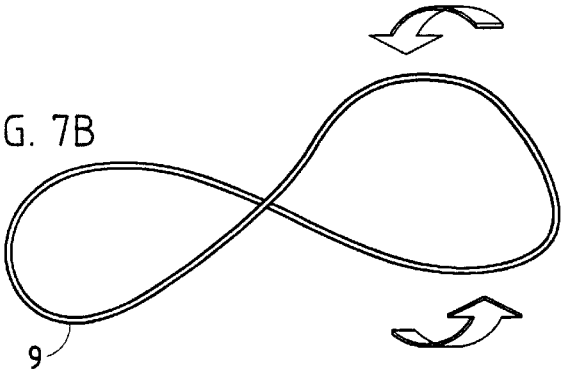
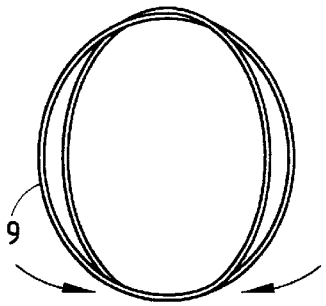
FIG. 7D
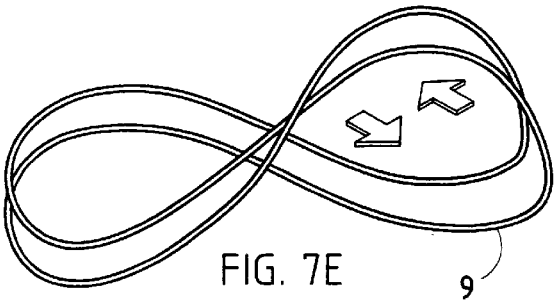
FIG. 7E
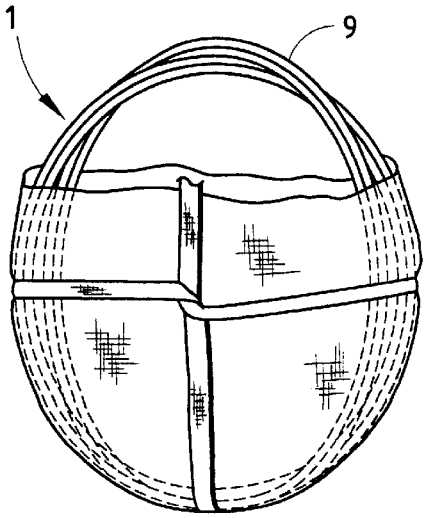
FIG. 7G
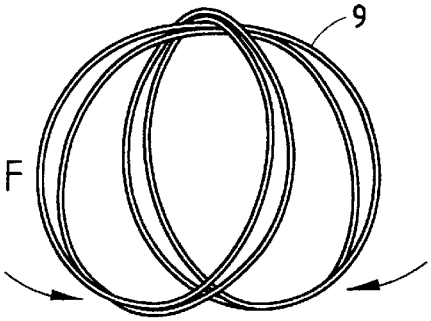
FIG. 7F

SELF-ERECTING LOOP STRUCTURE

FIELD OF THE INVENTION

The present invention generally relates to portable structures. In particular, the present invention relates to a self-erecting structure, such as a tent, having a stable, upright structure designed around a single loop, the resulting structure being compact, lightweight, and easily packable.

BACKGROUND OF THE INVENTION

Portable structures, such as tents, have been widely known and used for centuries. Unfortunately, such structures suffer from common problems that have also been widely known, with various solutions proposed through the years. A particular problem has involved the erecting, disassembly, and packing of such structures. For example, many tents include a plurality of separate parts, such as multiple poles and attaching members and require considerable effort to assemble and disassemble. Several of such tents require two or more persons to manipulate the tent and frame so that it can be readily erected. Further, these tents may be difficult or cumbersome to store and to transport. These problems are particularly disadvantageous for tents that are to be used during backpacking by one or two people. Under these circumstances, a light, easily erected and compacted tent structure is most desirable.

Solutions to these problems have been proposed through the years. Single piece tent structures that are compactable and easy to erect have been disclosed in U.S. Pat. No. 3,675,667 to Miller, U.S. Pat. Nos. 3,960,161, 3,990,463 and 4,825,892, each to Norman, U.S. Pat. No. 4,858,634 to McLeese, U.S. Pat. No. 5,163,461 to Invanovich et al. and U.S. Pat. No. 5,249,592 to Springer. The structures disclosed in these patents generally include a fabric shell forming the various outer surfaces of the erected structure, and a frame for supporting the shell. The frame is generally a single loop of flexible, coilable, resilient material secured along its length to the structure's fabric.

The tent structures disclosed in these patents, however, have not satisfactorily solved the existing problems. The tent of U.S. Pat. No. 3,960,161 to Norman, for instance, is generally wider about its upper portion than about its base portion, and is thus top heavy and tends to be unstable. To stabilize this tent of the prior art, tent end walls extend outward from the frame ends with ties for attaching to stakes in the ground. Such a configuration leads to difficulty in erecting as the structure will tend to sway or rock away from a level position.

Also, because ties and ground stakes are required to strain side walls to hold the tent structure in the desired upright position, stress is present in the ties, ground stakes, and side walls. This stress can lead to undesirable tearing of the body near the ties, untying during use, and dislodgment of ground stakes. This may also lead to a difficulty in using such a tent structure in areas where ground stakes are not practical, including hard surfaces such as concrete, rock, wood decking, wood flooring or on very soft surfaces such as in sand or very loose turf.

Also, these tent structures of the prior art require end panels that extend outward at an angle relative to the vertical so as to stabilize the top heavy structure. Outwardly extending end panels, however, are disadvantageous due to the inclination allowing for more direct rain or snow impact and accumulation. It is preferable to have end panels which extend generally in the vertical so as to better avoid direct impact of rain and snow.

An additional disadvantageous limitation of many prior art structures is the requirement of a floor. The tents structures of the prior art generally requires a floor so as to obtain the overall shape of the tent structure. But even with a floor, such tent structures of the prior art create stress on the frame to hold it in desired place. The stress in the floor resulting from holding the frame in place can lead to shear tearing and other premature floor failure.

Moreover, it is often desired that the tent structure be configured for use without a floor so as to apply to a larger range of applications, such as covering a pool, ground foliage, ground workspace or vehicles. Although the prior art does include descriptions of such tents without a floor, such embodiments generally have a "potato chip" shape. These structures, while generally useful for applications such as free standing coverings for a pool, foliage, vehicle or groundwork, also require tie-downs, vertical poles, struts and other additional supports or anchors to render such structures stable.

Also, given that such tents may be sized for one or more persons, as well as other various applications, a large entry passage panel may be desired for entering and exiting the tent. The structures taught by such tents in the prior art, however, inherently limit the entry passage to a relatively narrow, small panel at the end of the tent. Thus, entry and exit of this tent is made more difficult.

For the foregoing reasons, an unresolved need exists for an improved portable structure.

OBJECTS OF THE INVENTION

Therefore, it is an object of the invention to provide a portable structure that is self-erecting, easily compacted, and easily transported. It is a further object of the invention to provide a structure that is stable without external supports, and that may have the same general shape with or without the presence of a floor. It is a further object of the invention to provide a tent structure capable of providing side panels of a near vertical angle. It is still an additional object of the invention to provide a tent structure allowing for larger passageways into and out of the tent structure.

SUMMARY OF THE INVENTION

These and other problems and disadvantages of the prior art are overcome by the present invention, which generally comprises a portable structure or tent with a body of flexible, sheet like material supported by a single loop frame.

The body of the structure is preferably comprised of a roof portion with two opposing ends, and a pair of opposing side panels. The body is supported by and connected along its periphery to a support frame comprised of a single closed loop member comprised of resilient, flexible material. The frame and roof portion combine to form two opposing rounded upper edges and two opposing rounded lower edges. The body's side panels, if provided, depend substantially vertically from the roof portion.

With an upper frame width that is smaller than the width of the frame base portion, the structure of the present invention also has improved stability over prior art. This results in the structure being generally stable and level without the use of ground stakes or ties. Further, because of its stability, the tent structure of the present invention can use side walls which extend generally in the vertical to provide improved resistance to rain or snow penetration and accumulation over prior art configurations. Also, the structure of the present invention does not require a floor in order to keep its general shape. Moreover, the passage for entering and exiting the tent can be scaled to a larger size than found in tents of the prior art having a comparable size.

Because of the frame's coilable nature, it can easily be collapsed and coiled into a small, lightweight, easily packable structure. The preferred frame of the invention may be folded twice to compact it to a circumference approximately one quarter of its original circumference for easy and convenient packing. Further, because of its resiliency, the tent structure is essentially self-erecting. Upon release of the frame from a restrained coiled shape, it will un-coil and expand on its own to the erect form of the tent structure.

There are of course additional features of the disclosure that will be described hereinafter which will form the subject matter of the claims appended hereto. In this respect, before explaining the several preferred embodiments of the disclosure in detail, it is to be understood that the disclosure is not limited in its application to the details of the construction and arrangements set forth in the following description of illustrated in the drawings. The self-erecting tent structure of the present disclosure is capable of other embodiments and of being practiced and carried out in several ways. Also, it is to be understood that the phraseology and terminology employed herein are for description and not limitation.

Accordingly, the objects of the invention have been well satisfied. These advantages and others will become more fully apparent from the following detailed description when read in conjunction with the accompanying drawings.

BRIEF DESCRIPTION OF THE FIGURES

FIGS. 7(*a*) through 7(*g*) show a method of compacting an embodiment of the invention.

DETAILED DESCRIPTION OF THE PREFERRED EMBODIMENT

Figure 1:
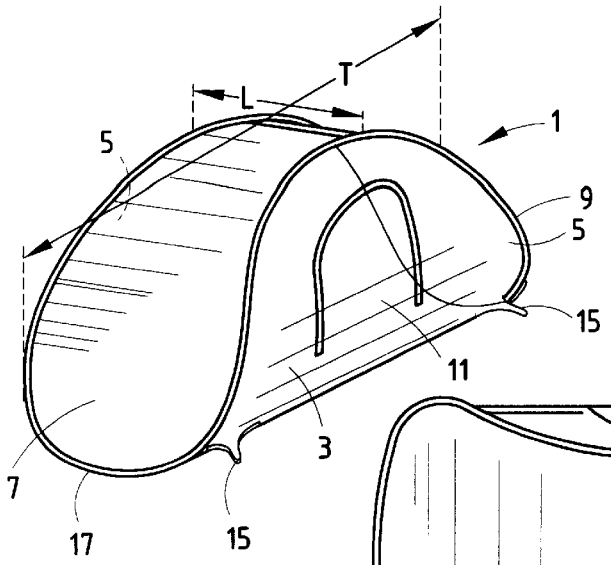
FIG. 1 is an isometric view of an embodiment of the invention.

The best mode for carrying out the invention is presented in terms of the preferred embodiment, wherein similar reference characters designate corresponding features throughout the several figures of the drawings. As used herein, the term "tent structure," whether singular or plural, is intended to refer to, and to be used interchangeably with, portable self-erecting structures in any form, including, but not limited to, camping and hiking tents, rain shields, sun screens, sports nets, utility covers and insect barriers.

Turning now to the Figures, FIG. 1 shows an isometric view of a preferred embodiment of the tent of the present invention. The overall size of the tent may be varied, with a preferred size generally a compact tent suitable for one or at most two persons.

The tent shown in FIG. 1 includes body 1, with side panels 3 and 5, and roof portion 7, as well as frame 9. As shown in FIG. 1 and in the elevation view of FIG. 2, roof portion 7 has longitudinal axis L and transverse axis T. For stability, the tent of the invention has a roof portion longitudinal axis L that is smaller than transverse axis T, and may preferably have a ratio of L:T in the range of 1:2. An additional embodiment of the tent of the invention may have an L axis dimension substantially near or equal to 0, the tent thereby having a generally peaked roof as viewed from the end as in FIG. 3.

Figure 2:
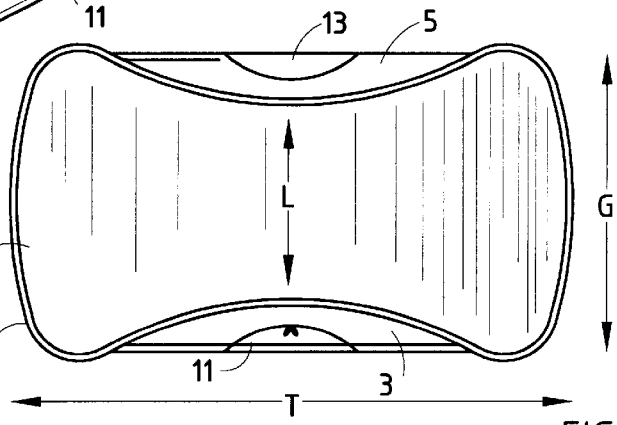
FIG. 2 is a top plan view of an embodiment of the roof portion of the invention.
Figure 3:
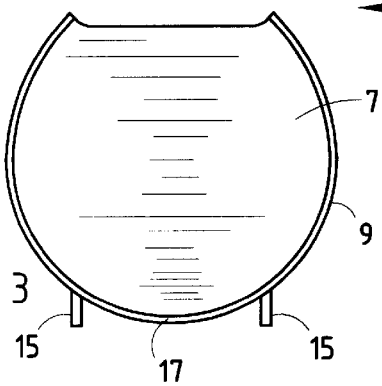
FIG. 3 is an end view of an embodiment of the invention.
Figure 4:
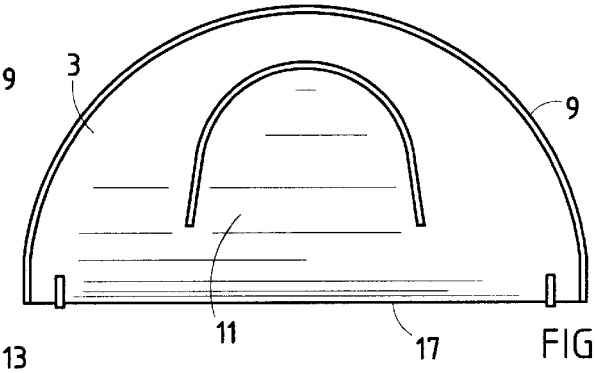
FIG. 4 is a front elevation view of an embodiment of the invention.
Figure 5:
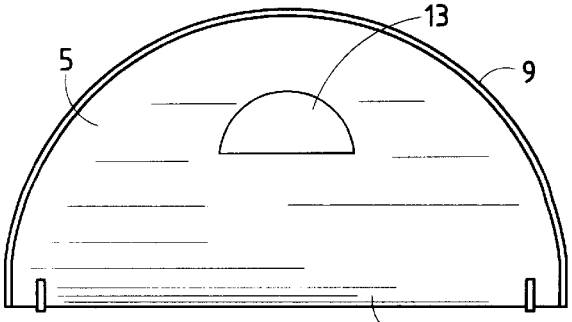
FIG. 5 is a rear elevation view of an embodiment of the invention.

FIGS. 2 and 3 offer other views of an embodiment of the tent of the invention with respect to its stability. As shown by the top plan view of FIG. 2 and the end view of FIG. 3, the tent of the invention has a width G near the ground that is larger than roof portion longitudinal axis L. This results in the generally hourglass shape of the roof portion 7 as evident in the top view of FIG. 2. Front and rear elevation views in FIGS. 4 and 5, respectively, show this general shape as well. This is also apparent from the perspective view of FIG. 6 of an embodiment of the frame of the invention. As can be seen in this view, the frame has two opposing lower rounded edges 31, and two opposing upper rounded edges 33. The radius of the lower rounded edges 31 is less than the radius of the upper rounded edges 33, and the structure is therefore generally stable.

As illustrated generally by these figures, the base of the tent of the invention is therefore wider than is the upper portion of the tent, providing a center of gravity that is below its mid-height point. The tent of the invention is thus not top heavy and can remain stable without any external support from the ground or other attachments. Ties, ground stakes, or other attachments to the ground may optionally be used to hold the tent of the invention to the ground to add stability, or to hold the tent in position against wind or other forces. If ties or attachments are used, however, stress on these ties will be less than on prior art disclosures as they are not used to stabilize an otherwise top heavy structure. This allows for the tent of the invention to be used under circumstances where attachment to the ground is not readily achieved; for instance on an indoor floor or on a flat rock surface. Under these circumstances, the tents disclosed in the prior art would be impractical or un-usable.

Body 1 of FIG. 1 may be comprised of a flexible, sheet-like material. While any of a variety of materials may be used for body 1, materials such as nylon or other similar synthetic fabrics are preferred for their low weight, durability, and strength. Fabrics that feature good water resistance, thermal insulation, and breathability may also be preferred.

The preferred body also includes a passageway 11 for entering and exiting, and a preferred mesh screen 13 for ventilation. Passageways and screens may be added or removed as may be desirable, and may be located on side panels 3 and 5, or roof portion 7. Because of the ratio of the transverse to longitudinal axis of the preferred tent of the invention, a relatively large passageway is possible where the passageway is provided on side panels 3 or 5. Thus, passageways that comprise the entire side panel are possible as may be desirable to place relatively large or awkwardly shaped articles in the tent. The preferred passageway includes a screen and a cover, the cover generally comprised of the same material as the body. The preferred cover and screen are connected to the body by common attachment means, such as zippers, snaps, ties, or hooks and loops. Preferred screen 13 also includes a cover which may be attached by zippers, snaps, ties, or hooks and loops to cover the mesh screen.

Preferred body 1 also includes a plurality of ties 15, which may be located near the four corners of body 1 for attachment to ground stakes or the like. The structure of FIG. 1 also may include a floor 17, which may be bound to the body along the lower edges thereof. Any suitable material, including the material of the body, may be used for the floor.

Because of the geometry of the tent of the present invention, presence of floor 17 is not required. This allows for an embodiment of the tent of the invention without a floor to be used for applications that require an open bottom, such as a cover for ground foliage, a work hole, vehicles, or over a pool. This is not possible with some prior art inventions which require presence of a floor.

As best shown by FIG. 3, side panels 3 and 5 extend downward from roof portion 7 at an angle that is near the vertical. Due to the stability of the tent of the invention, angles of descension within 10° of vertical may be realized. The side walls are not required to provide angled supports as is the case for many prior art configurations. This provides an important benefit over such prior art in that near vertical side panels will not be impacted by rain or snow at a direct angle, and will therefore be more resistant to resultant penetration and accumulation. In the case of sun screens, it may be desirable to omit one of the side panels 3 or 5 or replace the same with entirely screen-like material to further facilitate transverse air flow through the structure or allow. With sports nets, it may be desirable to omit one of the side panels 3 or 5 to further facilitate its use in the applicable sporting activity, such as an end goal.

Typically, body 1 will be constructed of several pieces stitched together as is convenient. It may be found that body 1 is easily constructed by joining separate individual pieces comprising roof portion 7, side panels 3 and 5, and floor 17 as a single piece.

Figure 6:
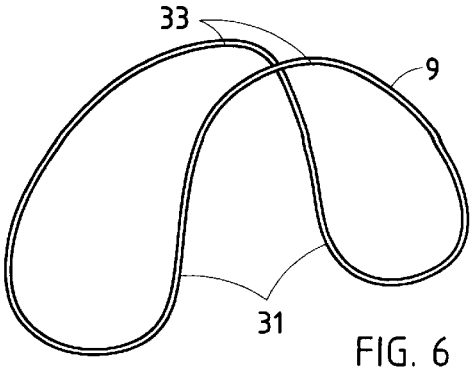
FIG. 6 is a perspective view of an embodiment of the frame of the invention.

Frame 9 of the tent is shown in isolation in FIG. 6. The frame 9 comprises a closed single loop of material which is strong, flexible, and resilient. Preferred materials of construction for frame 9 include reinforced fiberglass, spring steel, and suitable polymeric material. Frame 9 includes a pair of opposing lower rounded corners 31, and a pair of opposing upper rounded edges 33. Body 1 is held to frame 9 by retaining means, which preferably comprise a continuous stitched loop about roof portion 7 periphery that frame 9 resides within. Frame 9 is supported along its bottom rounded corners 31 by the ground.

The steps required to set up or compact the preferred tent of the invention are relatively few and straightforward, and may easily be achieved by a person working alone. FIGS. 7(*a*) through 7(*g*) shows a preferred method of compacting the frame of the invention which results in a final compacted circle structure of four turns representing a diameter of approximately one quarter of the erected frame diameter. To compact an erect tent, upper rounded corners 33 of frame 9 are brought toward one another. Once together, one or the other is twisted 180°, so that frame 9 is now in the general shape of a figure eight as shown in FIG. 7(*b*). The figure eight shape is then folded as in FIG. 7(*c*) to form two coincident circles as in FIG. 7(*d*). By compressing and twisting opposite sides of these circles, they again twist into a double figure eight shape as in FIG. 7(*e*). Folding this structure as in FIG. 7(*f*) results in a final compacted circle of four rings as in FIG. 7(*g*), with an approximate diameter of one quarter of the erected frame. Preferably, the resulting diameter is 26 inches or less. Restraints may be placed about this compacted structure to hold it in compacted shape.

This desirable compact size of one quarter of the original erect frame size allows for easy storage and transport. Particularly important is the smaller stored volume relative the fully deployed size of the tent of the present invention relative the tents of the prior art, wherein a compacted tent of one third the size of the deployed tent is disclosed. The desirably reduced size of the compacted tent of the present invention may more easily be carried in a backpack or otherwise easily carried by a camper. To erect the tent of the invention, the compacted frame is simply removed from its restraints allowing it to automatically expand to take shape.

In still another embodiment of the tent on the present invention, a plurality of individual tent structures can be attached to one another to form larger, single continuous enclosures. The individual tents of this particular embodiment may have two or more passages with attachment means for joining with other individual tents. Each, however, will be more stable owing to the unique structure of the present invention.

The objects of the invention have thus been attained in an economical, practical, and facile manner. While the preferred embodiment has been shown and described, it is to be understood that various further modifications and additional configurations will be apparent to those skilled in the art. It is intended that the specific embodiments and configurations disclosed are illustrative of the preferred and best modes for practicing the invention, and should not be interpreted as limitations on the scope of the invention as defined by the appended claims.

What is claimed is:

1. A portable, self-erecting structure comprising:

a body comprised of a flexible material having a roof portion with two opposing ends and a periphery, and a pair of opposing side panels; and a support frame consisting essentially of a single closed loop of resilient, flexible material for supporting said body, said frame connected to said body along said periphery of said roof portion, said frame having two opposing rounded upper edges and two opposing rounded lower edges, said respective lower edges connected to said respective body ends, said opposing side panels descending from said roof portion;

said body roof portion having a substantially hourglass shaped outline when viewed from above with said opposing upper rounded edges separated by a distance smaller than the width of said roof portion near said ends.

2. The portable, self-erecting structure of claim 1, wherein said side panels descend at an angle of within approximately 10° of vertical from said roof portion.

3. The portable, self-erecting structure of claim 1, wherein said body and said support frame are collapsible into a substantially flat circular shape.

4. The portable, self-erecting structure of claim 1, wherein said body and said support frame are collapsible into a substantially flat circular shape comprising four rings.

5. The portable, self-erecting structure of claim 1, wherein said body has a floor portion.

6. The portable, self-erecting structure of claim 1, further wherein one of said opposing side panels has a closeable passageway for entering and exiting said structure, and the other of said side panels has a screen portion for ventilation.

7. The portable, self-erecting structure of claim 6, wherein said side panels have substantially equal lengths, and said passageway has a width substantially equal to or greater than one half the length of each of said side panels.

8. The portable, self-erecting structure of claim 1, wherein said body has a plurality of fastening means for attaching said body to the ground.

9. The portable, self-erecting structure of claim 1, wherein said flexible material comprising said body is substantially impermeable to water and permeable to air.

10. A portable, self-erecting structure comprising:

a body comprised of a flexible material having a roof portion with two opposing ends and a periphery, and a pair of opposing side panels; and a support frame consisting essentially of a single closed loop of resilient, flexible material for supporting said body, said frame connected to said body along said periphery of said roof portion, said frame having two opposing rounded upper edges and two opposing rounded lower edges, said respective lower edges connected to said respective body ends;

said opposing side panels descending from said roof portion and said body roof portion having a longitudinal axis extending between said upper rounded edges, and a transverse axis extending between said roof portion ends, said transverse axis larger than said longitudinal axis.

11. The portable, self-erecting structure of claim 10, wherein a ratio of said longitudinal axis to said transverse axis is substantially equal to or less than 1:2.

12. The portable, self-erecting structure of claim 10, wherein said side panels descend at an angle of within approximately 10° of vertical from said roof portion.

13. A portable, collapsible enclosure comprising a body comprised of a flexible material having a roof portion with two opposing ends and a periphery, and a pair of opposing side panels, a foldable support frame consisting essentially of a single closed loop of resilient, flexible material for collapsibly supporting said body, said frame connected to said body along said periphery of said roof portion and when in a deployed condition, said frame having two opposing rounded upper edges having substantially equal radii and two opposing rounded lower edges, each having substantially equal radii, said respective lower edges being connected to said respective body ends, said opposing side panels descending from said roof portion; and said frame opposing top rounded edges having radii greater than said frame opposing lower rounded edges radii.

14. The portable, collapsible enclosure of claim 13, wherein said side panels descend at an angle of within approximately 10° of vertical from said roof portion.

15. A portable, self-erecting structure comprising a body comprised of a flexible material having a body roof portion with two opposing body ends and a periphery and a support frame consisting essentially of a single closed loop of resilient, flexible material for supporting said body, said frame connected to said body along said periphery of said roof portion, said frame having two opposing rounded upper edges and two opposing rounded lower edges, said respective lower edges connected to said respective opposing body ends, said body roof portion having a substantially hourglass shaped outline when viewed from above with said opposing upper rounded edges separated by a distance smaller than the width of said roof portion near said ends.

16. The portable, self-erecting structure of claim 15 wherein said frame, when in a deployed condition, defines two opposing rounded upper edges having substantially equal radii and two opposing rounded lower edges having substantially equal radii, said frame opposing top rounded edges having radii greater than said frame opposing lower rounded edges radii.

* * * * *